US006554280B2

(12) United States Patent
Mazzola

(10) Patent No.: US 6,554,280 B2
(45) Date of Patent: Apr. 29, 2003

(54) ANT BOARD GAME FEATURING ANT CAVE AND TUNNEL

(76) Inventor: Michael Clyde Mazzola, 30 Holly Berry Ct., Wading River, NY (US) 11792

( * ) Notice: Subject to any disclaimer, the term of this patent is extended or adjusted under 35 U.S.C. 154(b) by 0 days.

(21) Appl. No.: 10/097,085

(22) Filed: Mar. 12, 2002

(65) Prior Publication Data

US 2002/0130465 A1 Sep. 19, 2002

Related U.S. Application Data

(60) Provisional application No. 60/275,740, filed on Mar. 14, 2001.

(51) Int. Cl.[7] ..... A63F 3/00

(52) U.S. Cl. ..... 273/243; 273/272; 273/249

(58) Field of Search ..... 273/243, 248, 273/249, 272, 287, 292, 302; D21/334

(56) References Cited

U.S. PATENT DOCUMENTS 925,142 A * 6/1909 Spillman ..... 273/249
5,803,455 A * 9/1998 Falzarano ..... 273/255
5,820,125 A * 10/1998 Olsen ..... 273/248

* cited by examiner

*Primary Examiner*—Benjamin H. Layno
*Assistant Examiner*—V K Mendiratta
(74) *Attorney, Agent, or Firm*—Ware, Fressola, Van Der Sluys & Adolphson LLP

(57) ABSTRACT

Ant game is provided for playing with family members, where player's knowledge of mathematical relationships are applied, including greater than, less than, odd number or even number relationship, or a combination thereof. The game board has start and end spaces, sequentially disposed game spaces arranged therebetween, an ant cave arranged next to one sequentially disposed game space, an ant tunnel connecting one sequentially disposed game space and another non-adjacent sequentially disposed game space so that a player whose token lands on the first sequentially disposed game space may move across the ant tunnel to a given sequentially disposed game space located on the other side of the ant tunnel, and a move-to-ant-cave indicator on some sequentially disposed game spaces indicating that a player whose token lands thereon is to go to the ant cave.

10 Claims, 2 Drawing Sheets

ANT BOARD GAME FEATURING ANT CAVE AND TUNNEL

CROSS-REFERENCE TO RELATED APPLICATION

This application claims benefit U.S. provisional patent application serial No. 60/275,740, filed Mar. 14, 2001, hereby incorporated by reference in its entirety.

BACKGROUND OF THE INVENTION

1. Field of Invention

This invention relates to a game; and more particularly to a board game for children, as well as adults.

2. Related Art

Many different types of board games are known in the art, including U.S. Pat. No. 4,934,708 that describes a family quiz board game. However, the inventor is not aware of a board game having a picnic motif featuring ant movements and ant related structures for children, as well as adults, especially which reinforces each player's knowledge of mathematical relationships, such as odd numbers, even numbers and greater than and less than relationships.

SUMMARY OF THE INVENTION

In its broadest sense, the invention provides a method for playing a game involving family members, wherein each player's knowledge of mathematical relationships. The mathematical relationships may include a greater than relationship, a less than relationship, an odd number relationship, an even number relationship, or a combination thereof. The method includes the following steps:

Each player is provided with a token.

A game board is provided having a start space, an end space, a plurality of sequentially disposed game spaces arranged between the start space and the end space, an ant cave arranged in relation to one of the sequentially disposed game spaces, an ant tunnel arranged between and connecting a first one of the sequentially disposed game spaces and a second non-adjacent one of the sequentially disposed game spaces so that a player whose token lands on the first one of the sequentially disposed game spaces may move across the ant tunnel to a given one of the sequentially disposed game spaces located on the other side of the ant tunnel, and a move-to-ant-cave indicator on selected ones of said sequentially disposed game spaces indicating that a player whose token lands thereon is to go to the ant cave on the game board. The ant cave is typically located less than five game board spaces from the start space to effectively send the player almost back to the start space.

A mathematical relationship indicator is provided for indicating one or more mathematical relationships. The mathematical relationship indicator would typically include playing cards having the one or more mathematical relations printed thereon. However, the mathematical relationship indicator may also be any other device for providing a mathematical relationship in relation to a request from a player, e.g a computerized mathematical relationship indicator where a player presses a button and a mathematical relationship is displayed.

A random number generator is provided operable for providing a random number signifying a number of the sequentially disposed game board spaces to which each player advances the player's token. The random number generator would typically be a die having two or more numbers printed thereon. The die would be a cube having the numbers 1–6 printed thereon. However, the random number generator may also be any other device for providing a random number in relation to a request from a player, e.g a computerized random number generator.

Each player sequentially determines the number of sequentially disposed game board spaces to advance the player's token by operating the random number generator on each player's turn.

When the player's token lands on the first one of the sequentially disposed game spaces on a player's turn, then on a player's next turn a player's token may be advanced across the ant tunnel.

When the player lands on the selected ones of the sequentially disposed game board spaces having the move-to-ant-cave indicator, the player's token is moved to the ant cave.

The player's token is moved from the ant cave to one of the sequentially disposed game board spaces determined the number provided by the random number generator on the player's next turn after:

the player determines a mathematical relationship provided by the mathematical relationship indicator, which is typically done by picking a playing card, the player determines the random number provided by the random number generator signifying the number of the sequentially disposed game board spaces to which the player may advance the player's token, which is typically done by rolling the die, and the player moves the player's token from the ant cave only when to the random number satisfies the mathematical relation provided by the mathematical relationship indicator.

A game winner is determined as a first player that moves the player's token from the start space to the end space.

DESCRIPTION OF THE DRAWING

The drawing includes FIGS. 1–2 as follows.

DETAILED DESCRIPTION OF THE INVENTION

Game Parts Lists

The game includes the following parts:

1. A game board 10 shown in FIG. 1;
2. Game or playing cards shown in FIG. 2;
3. Ant game pieces for two or more players;
4. A game die having six sides; and
5. An instruction sheet.

FIG. 1: Game Board

Figure 1:
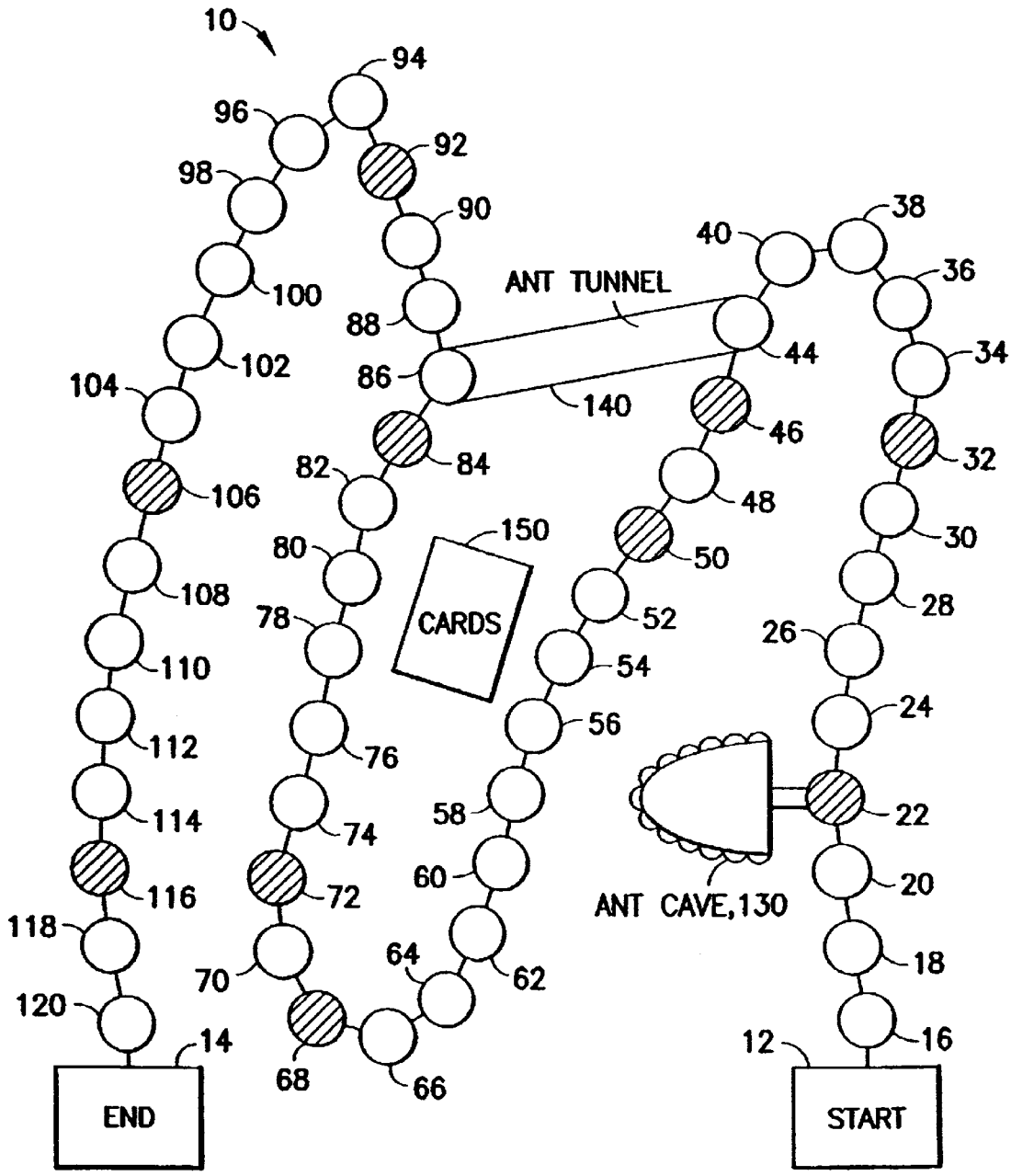
FIG. 1 shows a game board for a game that is the subject matter of the present invention.
Figure 2:
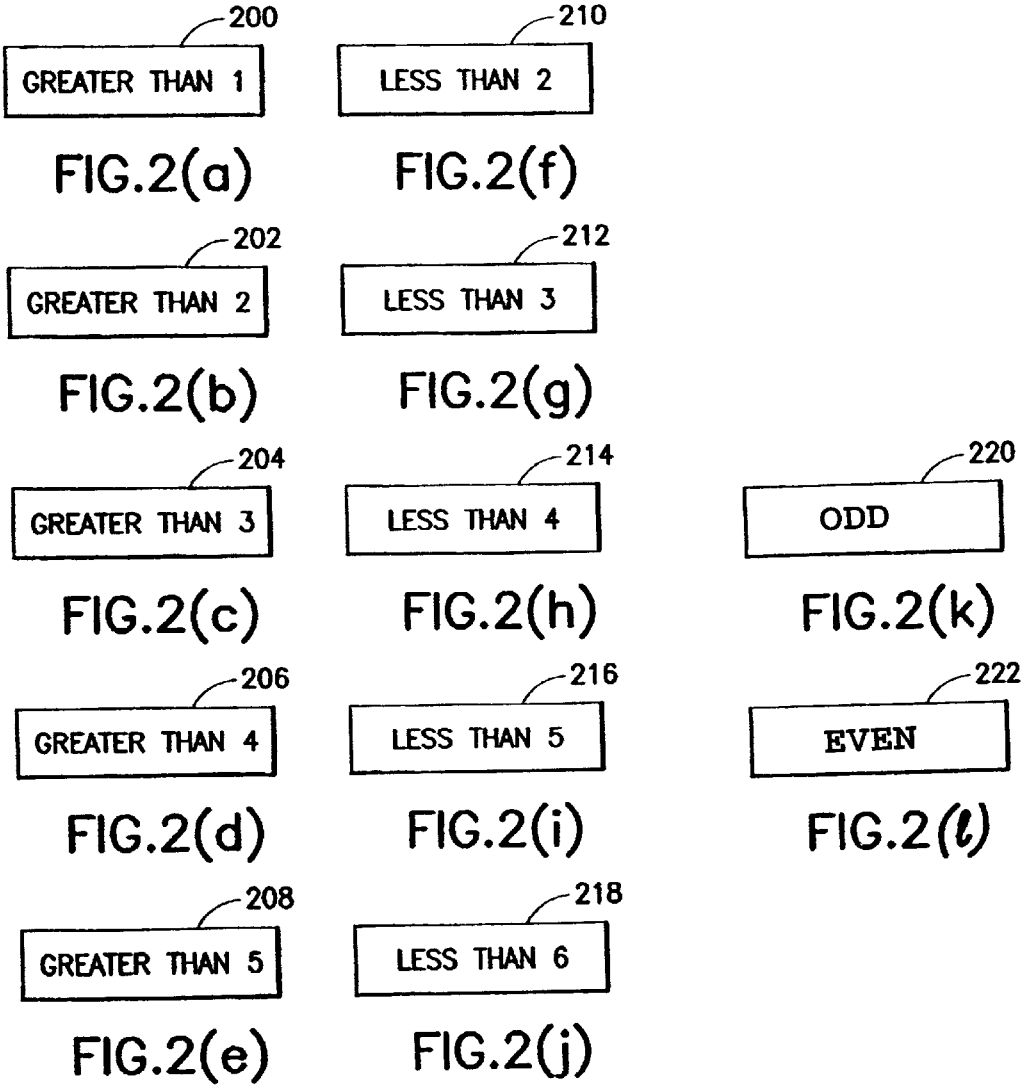
FIG. 2, including FIGS. 2(*a*) to (*l*), shows game cards for use with the game board shown in FIG. 1.

FIG. 1 shows a game board generally indicated as 10 having a start space or box 12, an end space or box 14, a series of game spaces or locations 16, 18, 20, . . . , 120 in between, an ant cave 130, an ant tunnel 140 and a location 150 for placing the game cards (FIG. 2). As shown, the ant cave 130 is positioned next to a space 22, and the ant tunnel 140 is position between spaces 44 and 86.

The start space or box 12 is the location where the ant game pieces or tokens of two or more players are placed to start the game.

The object of the game is to be the first player to land on the end space 14 and win the game.

The series of game spaces 16, 18, . . . , 120 are arranged between the start space 12 and the end space 14 where the players land after rolling the game die and moving their game piece or token. As shown, the series of game spaces 16, 18, . . . , 120 include shaded spaces 22, 32, 46, 50, 68, 72, 84, 92, 106 and 116 and non-shaded spaces 16–20, 24–30, 34–44, 48, 52–66, 70, 74–82, 86–90, 94–104, and 108–114 and 118–120.

FIG. 2: Game Playing Cards

FIG. 2 shows the game playing cards include cards 200, 202, 204, . . . , 218 having the following conditions:

1. Card 200—Greater than 1 (FIG. 2(*a*));
2. Card 202—Greater than 2 (FIG. 2(*b*));
3. Card 204—Greater than 3 (FIG. 2(*c*));
4. Card 206—Greater than 4 (FIG. 2(*d*));
5. Card 208—Greater than 5 (FIG. 2(*e*));
6. Card 210—Less than 2 (FIG. 2(*f*));
7. Card 212—Less than 3 (FIG. 2(*g*));
8. Card 214—Less than 4 (FIG. 2(*h*));
9. Card 216—Less than 5 (FIG. 2(*i*)); and
10. Card 218—Less than 6 (FIG. 2(*j*)).
11. Card 220—Odd (FIG. 2(*k*))
12. Card 222—Even (FIG. 2(*l*))

Ant Game Pieces or Tokens

The game pieces or tokens may include two or more different objects, for example, shaped like ants and having different colors for the different players to move around the game board 10.

Game Die

The game die may be a standard die shaped like a cube and having six sides numbered "1", "2", "3", "4", "5" and "6". The scope of the invention is also intended to include other types of random number generating means, including, but not limited to, a spinning wheel with numbers 1–6, or a computer random number generator.

The Instruction Sheet and Rules of the Game

This patent application in whole or in part may be used as the instruction sheet and include the following rules of play:

(1) To start the game, each player picks a different ant game piece or token and places it in the start space.

(2) The players must then determine which player goes first, second, third, etc.

(3) In order of play, each player takes a turn by rolling the game die and moving their ant game piece the number on the game die around the game board advancing in the direction from the start space 12 to the end space 14.

(4) When a player lands on a non-shaded space their turn ends, and the next player goes.

(5) When a player lands on a shaded space their ant game piece automatically moves into the ant cave 130, and the next player goes.

The Ant Cave 130

(6) In order for a player to get out of the ant cave 130, on their next turn the player picks a card and rolls the game die. If the number on the game die meets the mathematical condition or relationship on the game card, then the player moves their ant game piece the number on the game die with space 22 counted as their first move. For example, if the player picks a card saying "greater than 2" and rolls a "3" (or higher) on the game die, then the player moves their ant game piece out of the ant cave 130 the number on the game die (i.e. "3") to the space 26. If the player rolls a "2" (or less), then the player remains in the ant cave 130, and the next player goes. Alternatively, if the player picks a card saying "less than 5" and rolls a "4" (or less) on the game die, then the player moves their ant game piece out of the ant cave 130 the number on the game die (i.e. "4") to the space 28. In this case, if the player rolls a "5", then the player remains in the ant cave 130, and the next player goes. Moreover, as shown, if the player picks a card, rolls a "1" or "6" and meets the condition on the game card, then the player still remains in the ant cave 130 since the spaces 22 and 32 are shaded spaces. (Note that the way the game board 10 is presently configured the card 208—Greater than 5 (FIG. 2(*e*)) and the card 210—Less than 2 (FIG. 2(*f*) would effectively not be needed since if the player rolls a "1" or "6" they remain in the ant cave 130 since the spaces 22 and 32 are shaded spaces.) Alternatively, if the player picks a card saying "odd" and rolls a "1", "3" or "5" on the game die, then the player moves their ant game piece out of the ant cave 130 the number on the game die (e.g. if the player rolls a "3", then the player moves to the space 26). In this case, if the player rolls a "2", "4" or "6", then the player remains in the ant cave 130, and the next player goes. Alternatively, if the player picks a card saying "even" and rolls a "2", "4" or "6" on the game die, then the player moves their ant game piece out of the ant cave 130 the number on the game die (e.g. if the player rolls a "4", then the player moves to the space 28) In this case, if the player rolls a "1", "3" or "5", then the player remains in the ant cave 130, and the next player goes.

The Ant Tunnel 140

(7) If a player lands on the space 44, then on their next turn they may take the ant tunnel 140 or not at their discretion. (The player must land on the space 44 to take advantage of this option.) For example, if the player is on the space 44 and rolls a "1", then the player may move their ant game piece either to the shaded space 46 (go to ant cave 130) or the space 86. (Strategically, the player is likely to cross the ant tunnel and move their ant game piece to space 86 to advance more quickly to the end space 14.) Alternatively, if the player is on the space 44 and rolls a "4", then the player may move their ant game piece to either the space 52 or the space 92. (Strategically, the player is likely to move their ant game piece to space 52 and is not likely to cross the ant tunnel 140 to avoid going to the ant cave 130 after landing on the shaded space 92.) As described herein, the ant tunnel 140 itself is not considered a space to be counted when a player moves their ant game piece.

The Scope of the Invention

The scope of the invention is not intended to be limited to the number of shaded or non-shaded spaces, the color of the shaded or non-shaded spaces, the arrangement thereof between the start space 12 and the end space 14, the shaded spaces being permanently printed on the game board 10, or the color of the spaces. The scope of the invention is intended to include the game having separated shaded pieces (not shown) for arrangement by the players at the start of the game at different spaces along the path from the start space 12 to the end space 14. In this game, the game board could come without the shaded space being printed thereon and the players would arrange the separated shaded pieces (not shown) on different non-shaded spaces to make them into shaded spaces. The game is shown and described with one series of game spaces 16, 18, . . . , 120 arranged between the start space 12 and the end space 14. However, the scope of the invention is also intended to include two or more series of game spaces such as 16, 18, . . . , 120 arranged between the start space 12 and the end space 14 so players may take different paths to get from the start space 12 to the end space 14. The two or more series of game spaces may be interconnected so players may move from one series of game spaces to another series of game spaces to get from the start space 12 to the end space 14. Moreover still, the scope of the invention is also intended to include the non-shaded spaces being colored one color, for example, blue and the shaded spaces being colored a different color, for example, red.

The scope of the invention is not intended to be limited to the number of ant caves, the placement thereof between the start space 12 and the end space 14, or the ant cave(s) being permanently printed on the game board 10. For example, the game may have more than one ant cave, and different shaded spaces may send a player back to different ant caves. The scope of the invention is also intended to include the game having one or more separated ant cave pieces (not shown). for arrangement by the players at the start of the game at different spaces along the path from the start space 12 to the end space 14. In this game, the game board 10 could come without the ant cave 130 being printed on the game board 10, and the players would arrange the ant cave(s) at different spaces along the path from the start space 12 to the end space 14.

The scope of the invention is not intended to be limited to the position of the shaded space in relation to the ant cave 130. For example, the shaded space may be arranged "2", "3", "4" and "5" or more spaces away from the ant cave 130, instead of at the shaded spaces 22 and 32 as shown in FIG. 1 where rolls of "1" and "6" send the player back to the ant cave 130.

The scope of the invention is not intended to be limited to the number of ant tunnels, the placement thereof between the start space 12 and the end space 14, or the ant tunnel(s) being permanently arranged on the game board 10. For example, the game may have more than one ant tunnel, and different ant tunnels may advance a player to different spaces on the game board. The scope of the invention is also intended to include the game having one or more separated ant tunnel pieces (not shown) for arrangement by the players at the start of the game between different spaces along the path from the start space 12 to the end space 14. In this game, the game board 10 could come without the ant tunnel 140 being printed on the game board 10, and the players would arrange the ant tunnel(s) between different spaces.

The scope of the invention is not intended to be limited to the position of the shaded space in relation to the ant tunnel 140. For example, the shaded space may be arranged "1", "2", "3", "5", "6" or more spaces away from the ant tunnel 140, instead of at the shaded space 92 as shown in FIG. 1 where a roll of "4" sends the player back to the ant cave 130.

The scope of the invention is also intended to include the game having an erasable game board for receiving erasable magic marker(s). In this case, the game may come with permanently printed start and end spaces and non-shaded spaces therebetween, the players could color or mark the shaded spaces, ant cave(s) and ant tunnel(s) on the game board at the start of the game. After the game, the players may erase the shaded spaces, the ant cave(s) and the ant tunnel(s) from the game board, and color in new shaded spaces, ant cave(s) and ant tunnel(s) at different spaces at the start of the next game. The game may include different colored magic markers for coloring the shaded spaces, ant cave(s) and ant tunnel(s) in different colors.

The scope of the invention is not intended to be limited to the number of game cards or the conditions on the game cards. For example, the cards may also include one or more of the aforementioned game cards, and include game cards having the conditions "1", "2", "3", "4", "5" and "6", as well as a card saying "lose a turn", a card saying "you may send another player to the ant cave", or a card saying "exchange your ant game piece on the game board with an ant game piece of another player".

The scope of the invention is not intended to be limited to players moving only forward. The scope of the invention is intended to include the movement of ant game pieces in the forward and/or backward directions at their discretion.

The scope of the invention is intended to cover game play where one player may land on another player and either player or both players move back to the start space 12 or some other space on the game board.

The scope of the invention is not intended to be limited to how long a player remains in the ant cave 130. For example, a player may lose a turn after going to the ant cave 130, or a player may automatically get out of the ant cave 130 after picking three game cards and making three unsuccessful rolls of the game die.

The scope of the invention is not limited to how the order of play is determined. For example, each player may roll the game die and the player with the highest roll of the die goes first, and players follow in order of play in a clockwise manner in relation to their space around the game board.

The scope of the invention is not intended to be limited to the game die, or the number of sides on the game die. For example, the game may be played with a game die having other than six sides or two game dice.

It is also to be understood that the attached claims cover all of the generic and specific features of the invention herein described and all statements of the scope of the invention which, as a matter of language, might be said to fall therebetween.

I claim:

1. A method for playing a game involving family members, wherein each player's knowledge of mathematical relationships, comprising the steps of:

providing each player with a token;

providing a game board having a start space, an end space, a plurality of sequentially disposed game spaces arranged between the start space and the end space, an ant cave arranged in relation to one of the sequentially disposed game spaces, an ant tunnel arranged between and connecting a first one of the sequentially disposed game spaces and a second non-adjacent one of the sequentially disposed game spaces so that a player whose token lands on the first one of the sequentially disposed game spaces may move across the ant tunnel to a given one of the sequentially disposed game spaces located on the other side of the ant tunnel, and a move-to-ant-cave indicator on selected ones of said sequentially disposed game spaces indicating that a player whose token lands thereon is to go to the ant cave on the game board;

providing a mathematical relationship indicator for indicating one or more mathematical relationships;

providing a random number generator operable for providing a random number signifying a number of the sequentially disposed game board spaces to which each player advances the player's token;

sequentially determining for each player the number of sequentially disposed game board spaces to advance the player's token by operating the random number generator on each player's turn;

advancing on a player's next turn a player's token across the ant tunnel when the player's token lands on the first one of the sequentially disposed game spaces on a player's turn;

moving the player's token to the ant cave when the player lands on the selected ones of the sequentially disposed game board spaces having the move-to-ant-cave indicator;

moving the player's token from the ant cave to one of the sequentially disposed game board spaces determined the number provided by the random number generator on the player's next turn after:

determining a mathematical relationship provided by the mathematical relationship indicator, determining the random number provided by the random number generator signifying the number of the sequentially disposed game board spaces to which the player may advance the player's token, and moving the player's token from the ant cave only when to the random number satisfies the mathematical relation provided by the mathematical relationship indicator; and determining a game winner as a first player that moves the player's token from the start space to the end space.

2. A method according to claim 1, wherein the step of providing a mathematical relationship indicator includes providing playing cards having the one or more mathematical relations printed thereon.

3. A method according to claim 2, wherein the step of selecting the mathematical relationship includes picking a playing card.

4. A method according to claim 1, wherein the step of providing a random number generator includes providing a die having two or more numbers printed thereon.

5. A method according to claim 4, wherein the die is a cube having the numbers 1–6 printed thereon.

6. A method according to claim 4, wherein the method includes providing a game board having the ant cave located less than five game board spaces from the start space.

7. A method according to claim 1, wherein the ant cave is printed on the game board.

8. A method according to claim 1, wherein the ant tunnel is printed on the game board.

9. A method according to claim 1, wherein the method the step of providing the mathematical relationship indicator includes providing mathematic relationships including a greater than relationship indication, a less than relationship indication, an odd number relationship indication, an even number relationship indication, or a combination thereof.

10. A method for playing a game involving family members, wherein each player's knowledge of mathematical relationships, including odd number relationships, even number relationships, greater than number relationships, less than number relationships, or a combination thereof are applied, comprising the steps of:

providing each player with a token;

providing a game board having a start space printed thereon, an end space printed thereon, a plurality of sequentially disposed game spaces printed thereon and arranged between the start space and the end space, an ant cave location printed thereon and arranged in relation to one of the sequentially disposed game spaces, an ant tunnel printed thereon and arranged between and connecting a first one of the sequentially disposed game spaces and a second non-adjacent one of the sequentially disposed game spaces so that a player whose token lands on the first one of the sequentially disposed game spaces may move across the ant tunnel to a given one of the sequentially disposed game spaces located on the other side of the ant tunnel, and a move-to-ant-cave indicator on selected ones of the sequentially disposed game spaces indicating that a player whose token lands thereon is to go to the ant cave location on the game board;

providing playing cards for indicating one or more mathematical relationships including a greater than relationship, a less than relationship, an odd number relationship, an even number relationship, or a combination thereof;

providing a die having six sides operable for providing a random number between 1 and 6 signifying a number of the sequentially disposed game board spaces to which each player advances the player's token;

sequentially determining for each player the number of sequentially disposed game board spaces to advance the player's token by operating the random number generator on each player's turn;

advancing on a player's next turn a player's token across the ant tunnel when the player's token lands on the first one of the sequentially disposed game spaces on a player's turn;

moving the player's token to the ant cave location when the player lands on the selected ones of the sequentially disposed game board spaces having the move-to-ant-cave indicator;

moving the player's token from the ant cave location to one of the sequentially disposed game board spaces determined the. number provided by the random number generator on the player's next turn after:

selecting a playing card to determine a mathematical relationship, rolling the dies to determine the random number signifying the number of the sequentially disposed game board spaces to which the player may advance the player's token, and moving the player's token from the ant cave location only when to the random number satisfies the mathematical relation shown on the playing card; and determining a game winner as a first player that moves the player's token from the start space to the end space.

* * * * *

UNITED STATES PATENT AND TRADEMARK OFFICE

CERTIFICATE OF CORRECTION

PATENT NO. : 6,554,280 B2
DATED : April 29, 2003
INVENTOR(S) : Mazzola

It is certified that error appears in the above-identified patent and that said Letters Patent is hereby corrected as shown below:

Column 4,
Line 34, before "In" -- . -- should be inserted

Column 5,
Line 26, after "(not shown)" "." should be deleted

Column 8,
Line 51, after "the" "." should be deleted

Signed and Sealed this

Sixteenth Day of September, 2003

JAMES E. ROGAN
*Director of the United States Patent and Trademark Office*